US012326066B2

(12) United States Patent
Ridner

(10) Patent No.: US 12,326,066 B2
(45) **Date of Patent: *Jun. 10, 2025**

(54) FLOAT VALVE PRODUCING TURBULENT FLOW FOR WET SHOE TRACK

(71) Applicant: Weatherford Technology Holdings, LLC, Houston, TX (US)

(72) Inventor: Dmitry Ridner, Odessa, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/752,322

(22) Filed: Jun. 24, 2024

(65) Prior Publication Data

US 2024/0344425 A1 Oct. 17, 2024

Related U.S. Application Data

(63) Continuation of application No. 18/030,857, filed as application No. PCT/US2021/052450 on Sep. 28, 2021, now Pat. No. 12,055,013.

(Continued)

(51) Int. Cl.
*E21B 33/16* (2006.01)
*E21B 17/00* (2006.01)

(Continued)

(52) U.S. Cl.
CPC ..... *E21B 34/10* (2013.01); *E21B 33/16* (2013.01); *E21B 2200/04* (2020.05); *E21B 2200/05* (2020.05)

(58) Field of Classification Search
None
See application file for complete search history.

(56) References Cited

U.S. PATENT DOCUMENTS 2,178,846 A * 11/1939 Baker ..... E21B 33/14 166/222
2,662,602 A * 12/1953 Schnitter ..... E21B 33/14 166/69

(Continued)

FOREIGN PATENT DOCUMENTS

WO 2014186588 A2 11/2014

OTHER PUBLICATIONS

International Search Report and Written Opinion in PCT Appl. PCT/US2021/052450, mailed Dec. 23, 2021, 9 pages.

*Primary Examiner* — Matthew R Buck
*Assistant Examiner* — Douglas S Wood
(74) *Attorney, Agent, or Firm* — Cabello Hall Zinda, PLLC

(57) ABSTRACT

A float tool is used for controlling flow in tubing. The float tool comprises a housing, at least one valve, and at least one inset. The housing is configured to install on the tubing and has a longitudinal bore therethrough. The at least one valve is disposed in the longitudinal bore. The at least one valve is configured to allow the flow in a downbore direction through the longitudinal bore and is configured to prevent flow in an upbore direction through the longitudinal bore. The at least one inset is disposed in the longitudinal bore and is disposed downbore of the at least one valve. The at least one inset defines an orifice therethrough. The orifice has one or more vanes angled relative to the longitudinal bore. The one or more vanes are configured to produce turbulence in the flow in the downbore direction through the longitudinal bore.

20 Claims, 7 Drawing Sheets

Related U.S. Application Data

(60) Provisional application No. 63/110,649, filed on Nov. 6, 2020.

(51) Int. Cl.

| | |
|---|---|
| ***E21B 17/14*** | (2006.01) |
| ***E21B 33/14*** | (2006.01) |
| ***E21B 34/06*** | (2006.01) |
| ***E21B 34/10*** | (2006.01) |

(56) References Cited

U.S. PATENT DOCUMENTS

| | | | | |
|---|---|---|---|---|
| 3,385,370 | A | 5/1968 | Knox et al. | |
| 4,067,358 | A | 1/1978 | Streich | |
| 9,291,007 | B2 * | 3/2016 | Darbe | E21B 17/14 |
| 9,835,008 | B2 | 12/2017 | Rogers et al. | |
| 10,378,296 | B2 | 8/2019 | Downey et al. | |
| 12,055,013 | B2 * | 8/2024 | Ridner | E21B 33/165 |
| 2006/0000993 | A1 | 1/2006 | Kirk et al. | |
| 2006/0086507 | A1 | 4/2006 | Surjaatmadja et al. | |
| 2008/0110625 | A1 * | 5/2008 | Arcement | E21B 33/14 166/285 |
| 2015/0191984 | A1 | 7/2015 | Alberts | |
| 2016/0084014 | A1 | 3/2016 | Morrison | |
| 2018/0266206 | A1 * | 9/2018 | Berscheidt | E21B 34/10 |
| 2020/0386074 | A1 * | 12/2020 | Morrison | E21B 34/10 |
| 2021/0047898 | A1 | 2/2021 | Garcia et al. | |
| 2023/0313617 | A1 * | 10/2023 | Alhelal | E21B 34/14 166/332.8 |

* cited by examiner

FLOAT VALVE PRODUCING TURBULENT FLOW FOR WET SHOE TRACK

CROSS-REFERENCE TO RELATED APPLICATIONS

This application is a continuation of U.S. patent application Ser. No. 18/030,857 filed Apr. 7, 2023, which is 371 application of U.S. PCT Appl. No. PCT/US2021/052450 filed Sep. 28, 2021, which claims the benefit of U.S. Provisional Appl. No. 63/110,649 filed Nov. 6, 2020, each of which is incorporated herein by reference in its entirety.

BACKGROUND OF THE DISCLOSURE

Operators may use a "wet shoe" at the end of casing, liner, or other tubing where cement does not set around or obstruct a float valve (e.g., a check valve) at the end of the tubing. After cementing, fluid flow remains established through the tubing and float valve into the well. In this way, the wet shoe enables operators to conduct subsequent operations after cementing, such as pumping down plugs or perforating guns to the toe of the well.

Float equipment used for wet shoe applications can have problems with cement buildup around the float valves. Unless the cement is fully cleared from around them, the valves have the risk of becoming stuck, which can prevent injection for toe preparation. Due to the horizontal orientation of the float equipment in a lateral section of a well and due to the square shoulders of the float seats and retainers, residual cement can settle on the bottom of the internal part of the equipment.

The problem of residual cement causing issues may account for up to 5% of all float equipment failures on production strings. Being unable to inject through the float equipment can require operators to use highly expensive tubing-conveyed perforating (TCP) operations to proceed with the completion.

The subject matter of the present disclosure is directed to overcoming, or at least reducing the effects of, one or more of the problems set forth above.

SUMMARY OF THE DISCLOSURE

A float tool disclosed herein is for controlling flow in tubing. The float tool comprises: a housing, at least one valve, and one or more vanes. The housing is configured to install on the tubing and has a longitudinal bore therethrough. The at least one valve is disposed in the longitudinal bore. The at least one valve is configured to allow the flow in a downbore direction through the longitudinal bore and is configured to prevent flow in an upbore direction through the longitudinal bore. At least a portion of the longitudinal bore has the one or more vanes, which are angled relative to the longitudinal bore. The one or more vanes are configured to produce turbulence in the flow in the downbore direction through the longitudinal bore.

In another arrangement, a float tool disclosed herein is for controlling flow in tubing. The float tool comprises: a housing, at least one valve, and at least one inset. The housing is configured to install on the tubing and has a longitudinal bore therethrough. The at least one valve is disposed in the longitudinal bore. The at least one valve is configured to allow the flow in a downbore direction through the longitudinal bore and is configured to prevent flow in an upbore direction through the longitudinal bore. The at least one inset is disposed in the longitudinal bore downbore of the at least one valve and defines an orifice therethrough. The orifice has one or more vanes angled relative to the longitudinal bore. The one or more vanes are configured to produce turbulence in the flow in the downbore direction through the longitudinal bore.

The at least one valve can comprise a first of the at least one valve disposed upbore of a second of the at least one valve, and the at least one inset can comprise a first of the at least one inset disposed in the longitudinal bore downbore of the first valve and upbore of the second valve. Further, the at least one inset can comprise a second of the at least one inset disposed in the longitudinal bore downbore of the second valve.

The orifice can define a first opening at an upbore end being larger in size than a second opening at a downbore end. Alternatively, the orifice can define a first opening at an upbore end being a same in size as a second opening at a downbore end.

The one or more vanes can comprise a plurality of vanes disposed uniformly about a circumference of the orifice. Alternatively, the one or more vanes can comprise a plurality of vanes spiraling about the orifice.

The at least one valve can be selected from the group consisting of a flapper valve, a poppet valve, and a captured ball valve. As an example, the at least one valve can comprise a first of the at least one valve comprising: a first seat disposed in the longitudinal bore and defining a first flow passage; a first support disposed in the longitudinal bore downbore of the first seat; and a first poppet movably disposed on the support and biased toward the first seat. For this example, the at least one inset can comprise a first of the at least one inset disposed between the first seat and the first support and defining the orifice, the first poppet movably disposed in the orifice of the first inset.

The at least one valve can comprise a second of the at least one valve disposed downbore of the first inset and comprising: a second seat disposed in the longitudinal bore and defining a second flow passage; a second support disposed in the longitudinal bore downbore of the second seat; and a second poppet movably disposed on the support and biased toward the second seat. For this example, the at least one inset can be disposed between the first support and the second seat. The at least one inset can comprise: a first of the at least one inset disposed between the first seat and the first support and defining the orifice, the first poppet movably disposed in the orifice of the first inset; and a second of the at least one inset disposed between the second seat and the second support and defining the orifice, the second poppet movably disposed in the orifice of the second inset.

The foregoing summary is not intended to summarize each potential embodiment or every aspect of the present disclosure.

DETAILED DESCRIPTION OF THE DISCLOSURE

Figure 1A:
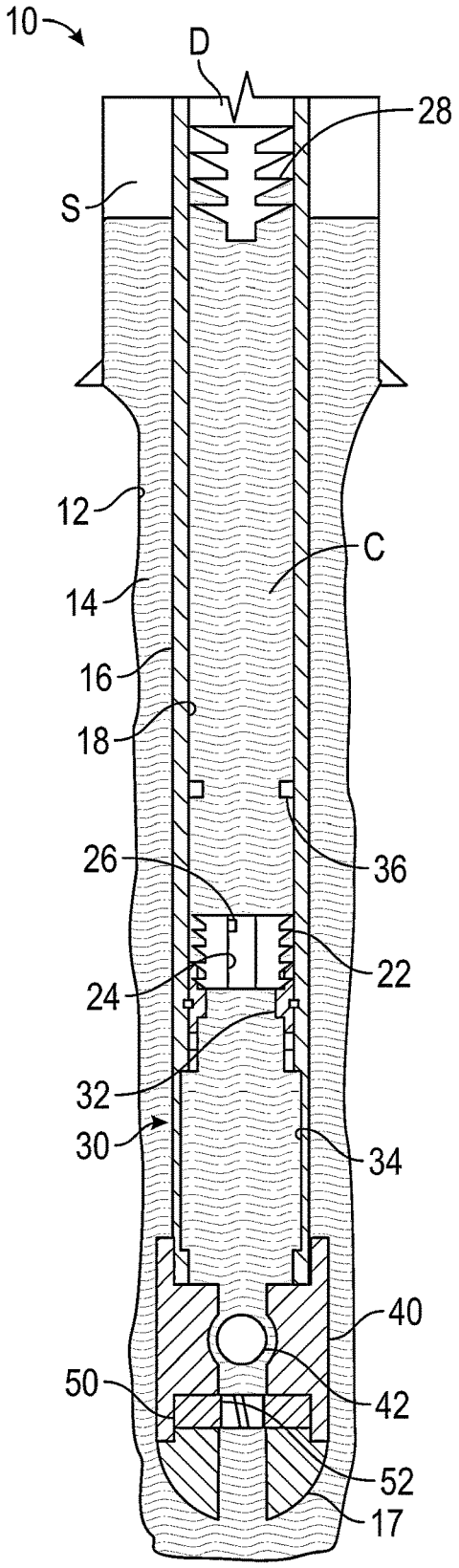
FIGS. 1A-1C illustrate an assembly during steps of a cementing procedure according to the present disclosure.
Figure 1B:
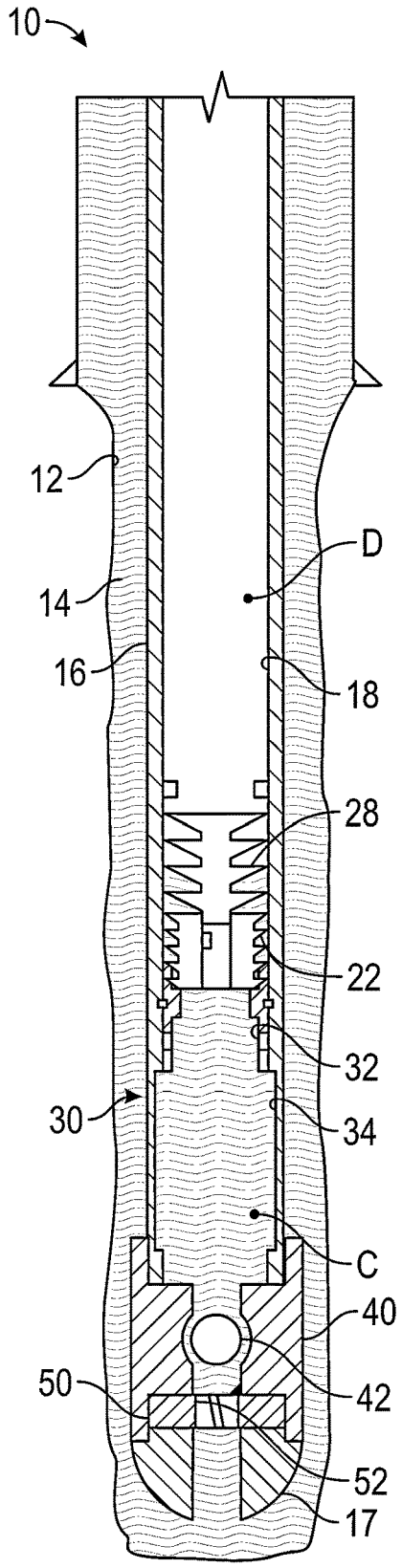
Figure 1C:
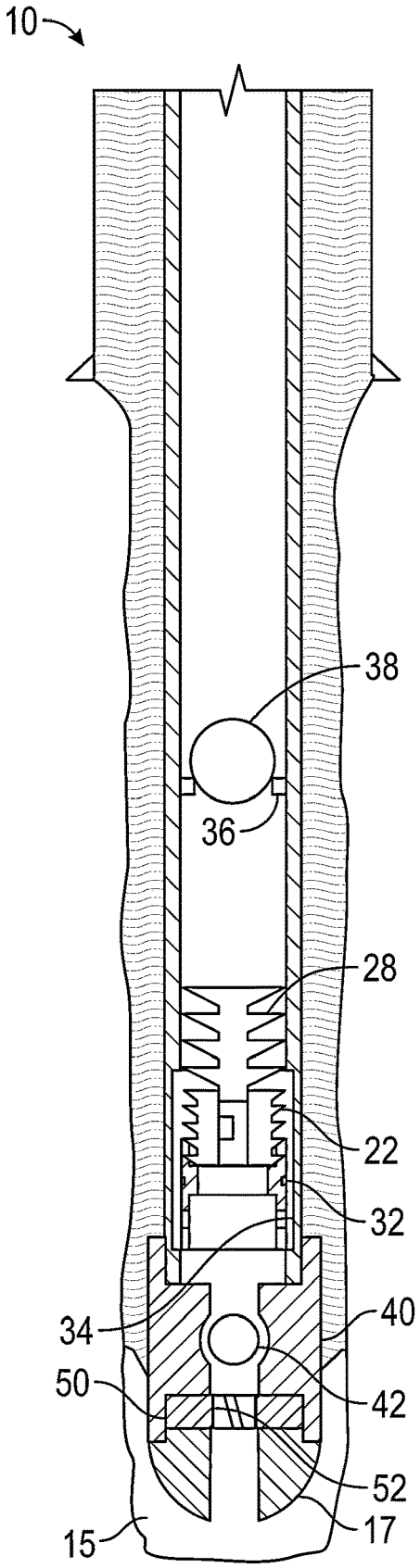

FIGS. 1A-1C illustrate an assembly 10 during steps of a cementing procedure according to the present disclosure. Tubing 16 is being cemented in a borehole 12. The tubing 16 referred to herein may be casing, production tubing, liner, tubulars, or the like.

The assembly 10 includes a wet shoe tool 30, a float tool 40, and a guide or shoe 17. The wet shoe tool 30 is disposed on the tubing 16 and can be used with or can be part of a casing shoe/landing collar. For example, the wet shoe tool 30 can be disposed above the float tool 40, a hydraulic landing collar, or the like. The float tool 40 is disposed on the tubing 16 and can be a float collar or a float shoe having a check valve 42. The guide or shoe 17 can be part of the float tool 40 and can be an eccentric shoe guide or the like.

The wet shoe tool 30 is used for creating a wet shoe track in an operation that opens the flow path through the float shoe 17 to the formation after cementing. There are a number of techniques for creating a wet shoe track in a cementing operation. One technique can use a wet shoe tool, such as disclosed in copending U.S. application Ser. No. 16/539,305, filed 13 Aug. 2019, which is incorporated herein by reference.

In the cementing procedure as shown in FIG. 1A, an initial fluid slug S is pumped down the tubing 16 followed by a bottom wiper plug 22. The bottom wiper plug 22 can be launched from a cementing head. The bottom plug 22 displaces fluids through the tubing 16 while preventing cement contamination. The bottom wiper plug 22 as disclosed herein may be any conventional cement/wiper plug used in well cementing operations known in the art. Cement C is pumped down through the tubing bore 18 behind the bottom plug 22. The cement C may be supplied through a work string (not shown) or through the tubing 16 if the work string is removed.

The initial fluid slug S can pass out of the check valve 42 of the float tool 40. The bottom wiper plug 22 is pumped until it lands in a landing insert 32 of the wet shoe tool 30. A passage 24 through the bottom plug 22 has a closure 26 that is opened by pressure, allowing the cement C pumped down through the bore 18 of the tubing 16 to pass through the bottom wiper plug 22, out the float tool 40 and the guide or shoe 17, and into the annulus 14 of the borehole 12. The closure 26 can be a breachable element, such as a rupture disc.

Behind the cement C, a top wiper plug 28 as shown in FIG. 1A is pumped down the tubing bore 18 using a spacer or displacement fluid D, such as water. This fluid D can include a retardant. The top wiper plug 28 as disclosed herein may be any conventional cement/wiper plug used in well cementing operations known in the art.

The top wiper plug 28 can be a stinger dart that is pumped behind the cement C. The top plug 28 wipes the inside of the tubing 16, providing a mechanical barrier between the cement C and the displacement fluid D. Eventually, as shown in FIG. 1B, the top wiper plug 28 reaches the bottom wiper plug 22 and closes the fluid passage 24 through the bottom plug 22. For example, a head of the top wiper plug 28 can fit into the plug's passage 24 and can latch therein.

Once the top plug 28 is landed, fluid flow through the end of the tubing 16 may be established to form a wet shoe track 15 for conducting subsequent operations. In particular and as shown in FIG. 1C, pressure applied to a predetermined level behind the wiper plugs 22, 28 activates the wet shoe tool 30 by shifting the landing insert 32 into a bypass 34 of the tool 30. The activated wet shoe tool 30 opens an internal bypass so fluid can pass through the tool 30. The opened fluid bypass allows operators to displace the cement C and to clear the float shoe 17, leaving a desired wet shoe track 15. The displacement fluid D can now pass through the wet shoe tool 30 to create the wet shoe track 15, which may have benefits in the implementations disclosed herein. For example, fluid communication is now established through the tubing 16 so additional operations can be performed without the need to perforate the tubing 16.

To help produce the wet shoe track 15 and help prevent residual cement from remaining in the float tool 40 and other components of the assembly 10. The assembly 10 includes a turbulent flow device 50 disposed inside or adjacent the float equipment. For example, the turbulent flow device 50 can be incorporated into the float tool 40. The turbulent flow device 50 makes the flow of fluid turbulent inside the assembly 10 to clear residual settled cement from around and beyond the float tool 40, the float valve 42, the shoe 17, and the like. The turbulent flow device 50 can include angled or spiraling vanes, channels, or the like. The vanes encourage fluid to jet into hard-to-clean corners of the float tool's and valve's internal surfaces, and thus can help eliminate stagnant areas of flow on the inside of the float tool 40, the float valve 42, the shoe 17, etc. The effect can also be achieved by adding spiral grooves to the float seats and by using other techniques disclosed herein.

After cementing, the integrity of the cemented tubing 16 can be tested by pumping a plug 38, such as a ball, down the tubing 16 to the wet shoe tool 30. The plug 38 lands in a seat 36 in the tool 30 (or lands elsewhere in the tubing 16). Pressure applied against the seated plug 38 can then be used to test the integrity of the cemented tubing 16 to desired test levels. Preferably, the plug 38 is composed of a self-removable material that dissolves, disintegrates, or otherwise removes in time to re-establish flow through the tubing's bore 18 so subsequent operations can be performed.

Figure 2:
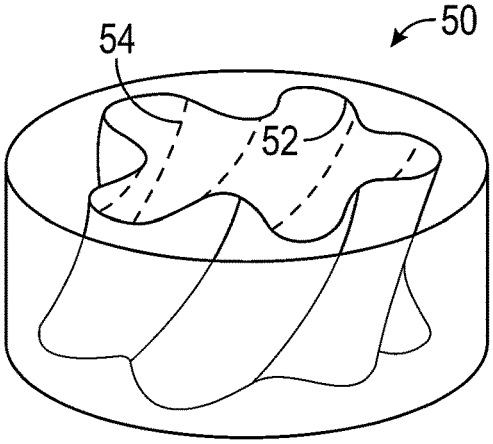
FIG. 2 illustrates a perspective view of a turbulent flow device for a float tool according to the present disclosure.

FIG. 2 illustrates a perspective view of a turbulent flow device 50, which can be an inset or inside wall for a float tool (40), float valve (42), or other component of the assembly (10) according to the present disclosure. At least a portion of the longitudinal bore (i.e., an orifice 52) of the turbulent flow device 50 has one or more vanes 54 angled relative to the longitudinal bore or orifice 52. The one or more vanes 54 are configured to produce turbulence in the flow in the downbore direction through the longitudinal bore or orifice 52.

This turbulent flow device 50 can be portion of the bore of the float tool (40), can be a fixture disposed inside the float tool (40), or can be formed as part of a flow passage in the float tool (40). As a separate component, for example, the turbulent flow device 50 may be a ring, a spacer, a disk, an insert, or other such element disposed in or formed in the float tool's bore and having the orifice 52 profiled with the one or more vanes 54 to produce the turbulent flow.

The turbulent flow device 50 is a preventative solution that aims to lower the risk of float failure, and the turbulent flow device 50 is a significantly less expensive alternative to possible remediation with TCP. The turbulent flow device 50 can minimize square shoulders and can enhance flow.

Figure 3A:
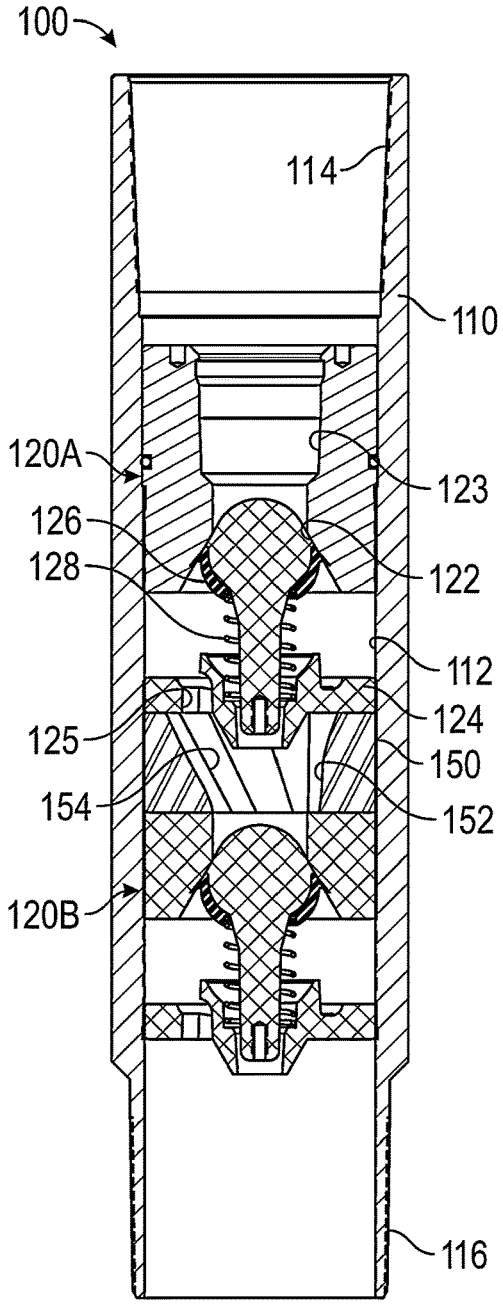
FIG. 3A illustrates a cross-sectional view of a float tool of the present disclosure.
Figure 3B:
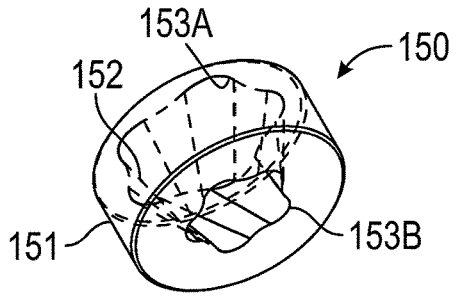
FIG. 3B illustrates a perspective view of a turbulent flow device of the float tool in FIG. 3A.

FIG. 3A illustrates a cross-sectional view of a float tool 100 of the present disclosure, and FIG. 3B illustrates a perspective view of a turbulent flow device 150 of the float tool 100 in FIG. 3A. As disclosed herein, the float tool 100 is used for controlling flow in tubing. The float tool 100 comprises a housing 110, at least one valve 120A-B, and at least one turbulent flow device or inset 150.

The housing 110 is configured to install on the tubing (16) and has a longitudinal bore 112 therethrough. As is typical, the housing 110 can include box and pin ends 114, 116 of threaded connections for connecting to tubing and/or housings of other completion equipment. The longitudinal bore 112 communicates with the tubing (16) so displacement fluid, cement, and the like can be pumped down through the housing 110 in a cementing operation.

The at least one valve 120A-B is disposed in the longitudinal bore 112. In general, the at least one valve 120A-B is a check valve, being configured to allow the flow in a downbore direction through the longitudinal bore 112 and configured to prevent flow in an upbore direction through the longitudinal bore 112. A number of check valves can be used, including a flapper valve, a poppet valve, and a captured ball valve.

In the present example, two valves 120A-B are used in the housing 110 and include poppet valves. The first valve 120A is disposed upbore of the second valve 120B. As poppet valves, the valves 120A-B each includes a seat 122, a support 124, and a poppet 126. The seat 122 is disposed in the longitudinal bore 112 and defines a first flow passage 123. (The flow passage 123 can have latch profiles and other features for engaging plugs, darts, etc.) The support 124 is disposed in the longitudinal bore 112 downbore of the seat 122. The poppet 126 is movably disposed on the support 124 and is biased toward the seat 122 with a spring 128. The support 124 can include openings 125 for flow to pass through. Pressure uphole of the poppet 126 can unseat the poppet 126 from the seat 122 against the bias of the spring 128 so fluid can pass in a downbore direction. However, the poppet 126 closes and prevents upbore flow when there is insufficient pressure uphole or when there is back pressure.

The at least one flow device or inset 150 is disposed in the longitudinal bore 112 downbore of the at least one valve 120A and defines an orifice 152 therethrough. The orifice 152 has one or more vanes 154 angled relative to the longitudinal bore 112. As discussed in more detail below, the one or more vanes 154 are configured to produce turbulence in the flow in the downbore direction through the longitudinal bore 112.

As shown in FIG. 3A, one turbulent flow device or inset 150 is disposed in the longitudinal bore 112 between the support 124 of the first valve 120A and the seat 122 of the second valve 120B. In one or more arrangements, the turbulent flow device 150 and its features can be incorporated into one or more of the housing 110, the support 124, the seat 122, and the like in the float tool 100. As shown here, this inset 150 is depicted as a separate component from the housing 110, support 124, seat 122 and the like. As such the inset 150 can be a ring of drillable material.

As shown in FIG. 3B, the orifice 152 of the inset 150 can define a first opening 153*a* at an upbore end being larger in size than a second opening 153*b* at a downbore end. The one or more vanes 154 can include a plurality of vanes disposed uniformly about a circumference of the orifice 152. The vanes 154 can spiral about the orifice 152. The orifice 152 can be angled, having a wider uphole opening 153*a* and a narrower downhole opening 153*b*.

Figure 4A:
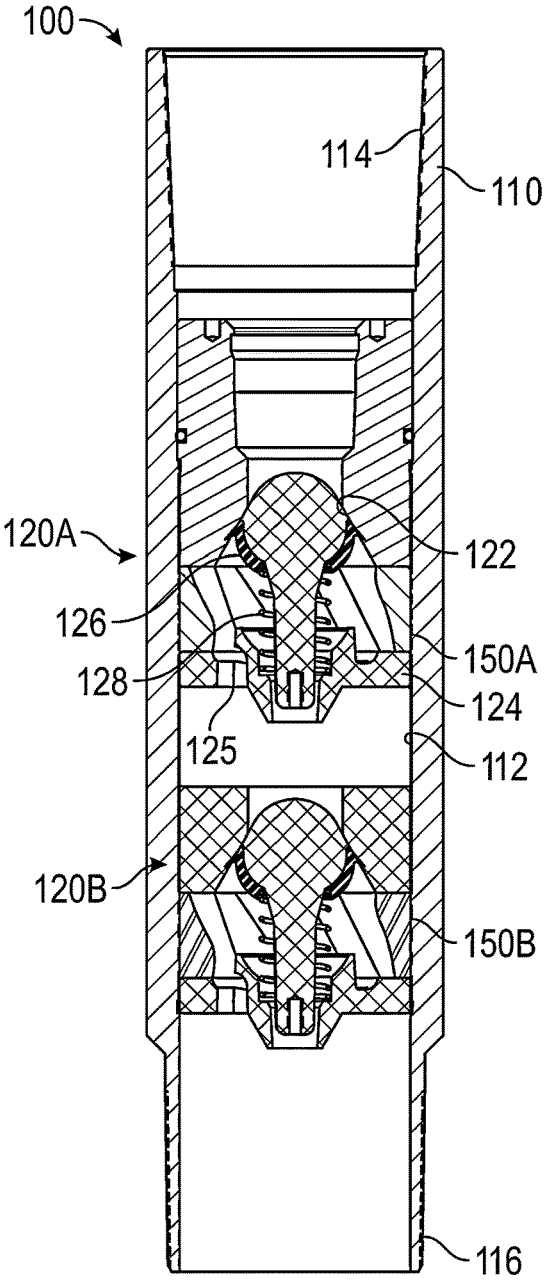
FIG. 4A illustrates a cross-sectional view of another float tool of the present disclosure.
Figure 4B:
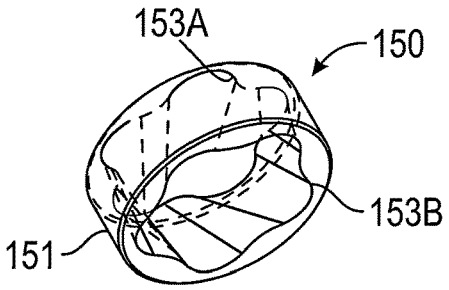
FIG. 4B illustrates a perspective view of a turbulent flow device of the float tool in FIG. 4A.

FIG. 4A illustrates a cross-sectional view of another float tool 100 of the present disclosure, and FIG. 4B illustrates a perspective view of a turbulent flow device 150 of the float tool 100 in FIG. 4A. This float tool 100 can be similar to that discussed above so that like reference numerals are used.

As shown in FIG. 4A, the float tool 100 can include first and second valves 120A-B, which are poppet valves in the present example. The first valve 120A is disposed upbore of the second valve 120B. Here, each of the valves 120A-B has a flow device or inset 150A-B disposed in the longitudinal bore 112 of the housing 110.

As poppet valves, the valves 120A-B each includes a seat 122, a support 124, and a poppet 126. The seat 122 is disposed in the longitudinal bore 112 and defines a first flow passage 123. The support 124 is disposed in the longitudinal bore 112 downbore of the seat 122. The poppet 126 is movably disposed on the support 124 and is biased toward the seat 122. The support 124 can include openings 125 for flow to pass through.

In this device, each of the turbulent flow devices or insets 150 is disposed between the seat 122 and the support 124, and the poppet 126 is movably disposed in the orifice 152 of the inset 150. In this configuration, the inset 150 not only provides the benefits of turbulent flow, but also takes up void spaces and eliminates hard shoulders where residual cement and debris could foul the float equipment.

In one or more arrangements, the turbulent flow device 150 and its features can be incorporated into one or more of the housing 110, the support 124, the seat 122, and the like in the float tool 100. As shown here, this inset 150 is depicted as a separate component from the housing 110, support 124, seat 122 and the like. As such the inset 150 can be a ring of drillable material. As shown in FIG. 4B, the orifice 152 can define a first opening 153*a* at an upbore end that is a same in size as a second opening 153*b* at a downbore end.

As noted in previous arrangements, the valves 120 in the float tool 100 can include a flapper valve, a poppet valve, a captured ball valve, or any other suitable form of check valve to prevent flow in a upbore direction and to allow flow in a downbore direction. For example, FIGS. 5A-5G illustrate cross-sectional views of additional float tools of the present disclosure having other forms of valves and turbulent float devices.

Figure 5A:
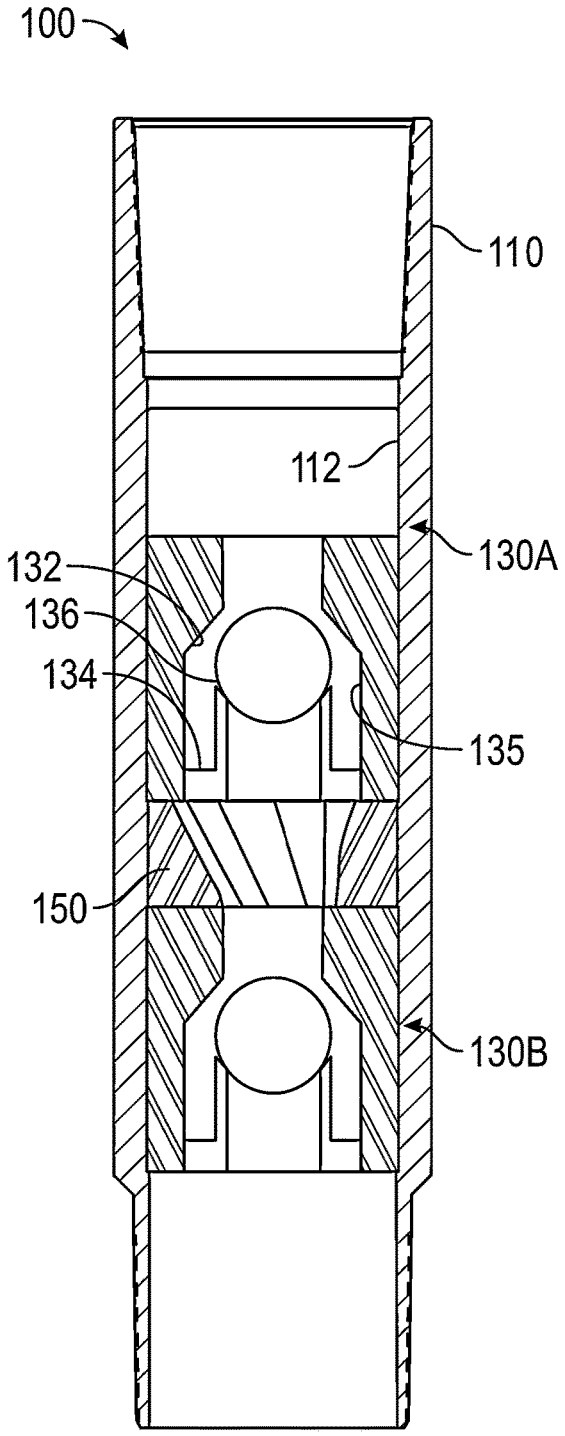
FIGS. 5A-5I illustrate cross-sectional view of additional float tools of the present disclosure.
Figure 5B:
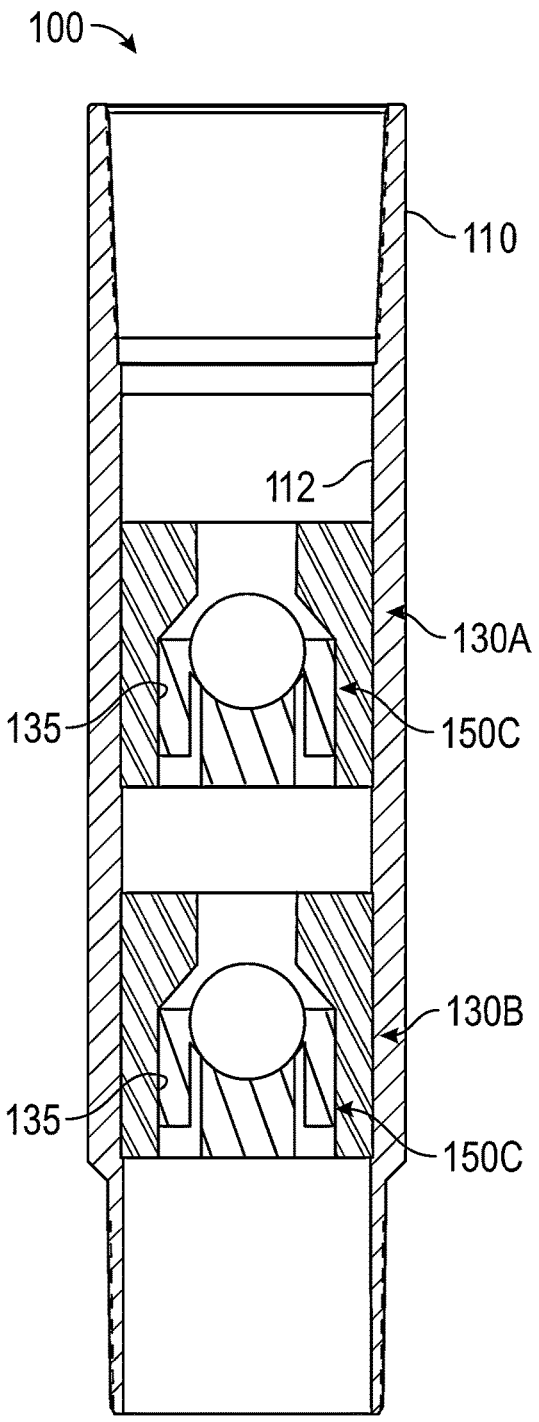

As shown in FIGS. 5A-5B, the valves 130A-B include captured ball valves. In general, the captured ball valve 130A-B includes a seat 132 and a support 134. The ball 136 is captured between the seat 132 and the support 134. When engaged with the seat 132, the ball 136 prevents flow in the upbore direction. When engaged on the support 134, the ball 136 allows flow in the downbore direction.

As shown in FIG. 5A, a turbulent flow device or inset 150 can be disposed between the two captured ball valves 130A-B. This configuration of the inset 150 can be similar to that described above with reference to FIG. 3B.

An alternative configuration is shown in FIG. 5B. Here, the inside wall 135 of the captured ball valves 130A-B in which the balls 136 are disposed can include one or more vanes to produce the turbulent flow. This configuration can be combined with any of the others.

Figure 5C:
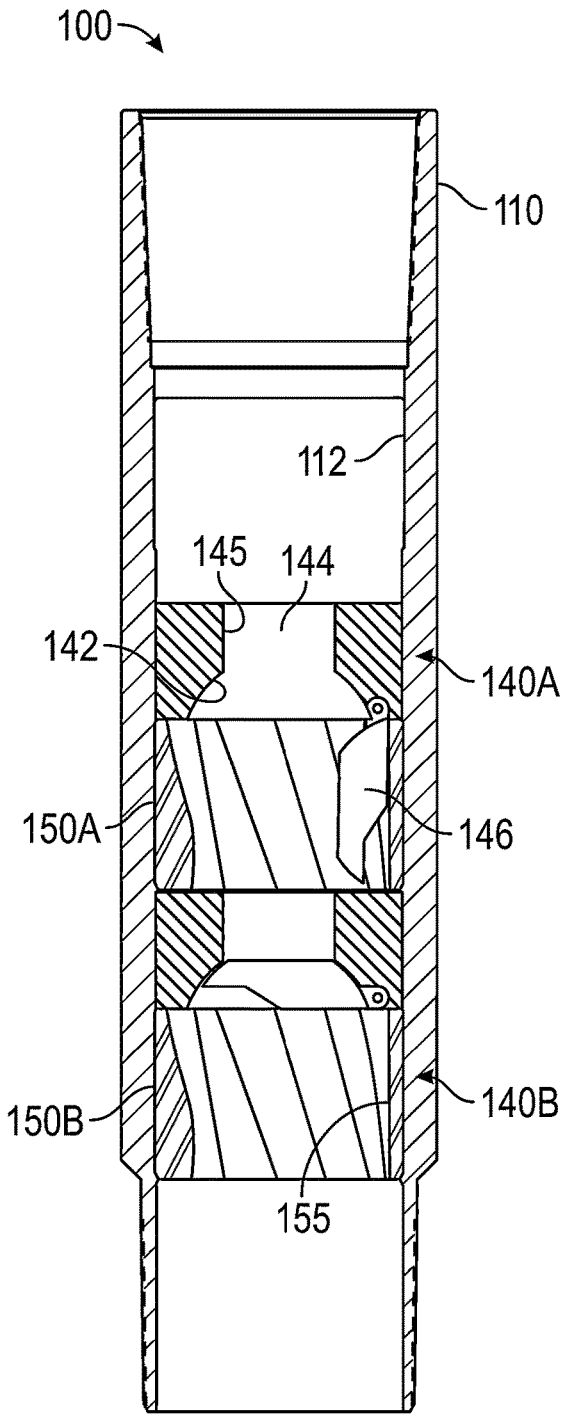
Figure 5D:
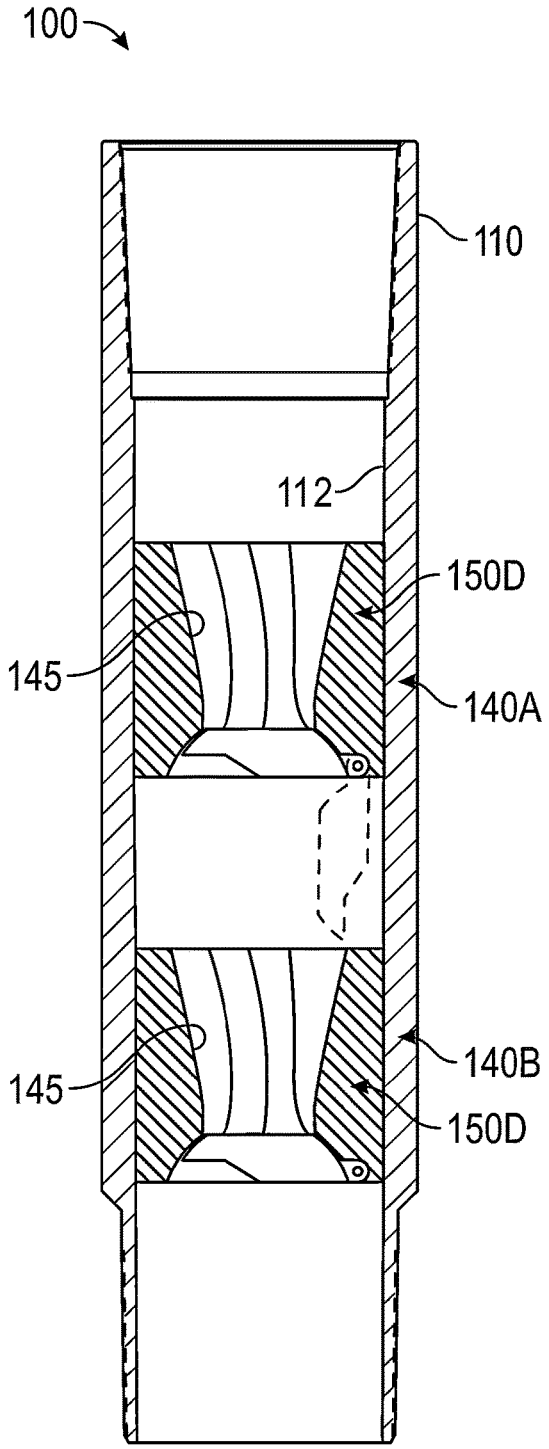

As shown in FIGS. 5C-5D, the valves 140A-B include flapper valves. In general, the flapper valves 140A-B each includes a seat 142 having a flow passage 144 and includes a flapper 146 hingedly movable relative to the seat 142.

As shown in FIG. 5C, a turbulent flow device or inset 150A can be disposed between the flapper valves 140A-B. Another turbulent flow device or inset 150B can be disposed downbore of the lower flapper valve 140B. These configurations for the insets 150A-B can be similar to that described above with reference to FIG. 3B. To accommodate the open flapper 156, the orifice 152 of the inset 150A-B can include a relief or cutaway 155.

An alternative configuration is shown in FIG. 5D. Here, the inside wall 145 of the seat's flow passage 144 can include one or more vanes to produce the turbulent flow. In that sense, the flapper 146 can be disposed on an inset 150D, which can include a seat in the orifice for the flapper 146 to engage.

Figure 5E:
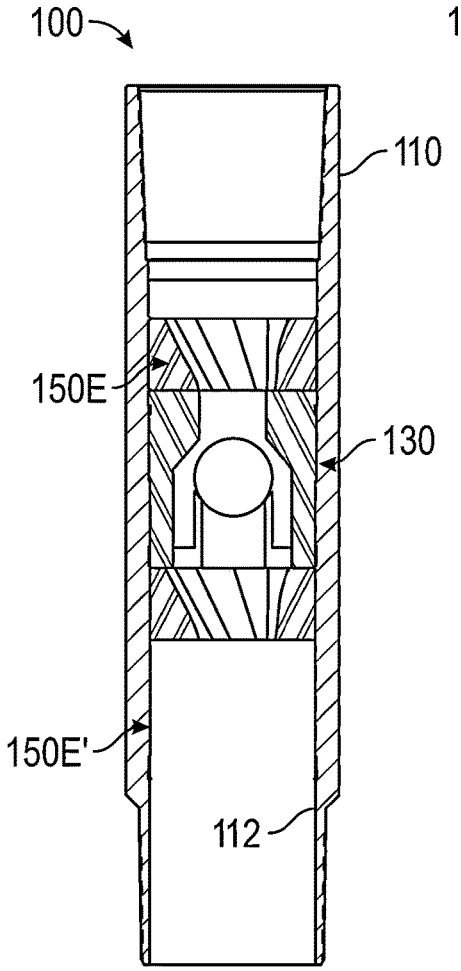

As shown in FIG. 5E, the float tool 100 of the present disclosure can include a turbulent float device 150E disposed upbore of a valve 130, which just happens to be a captured ball valve. As also shown, the float tool 100 of the present disclosure can include one or more check valves 130 (one being depicted). Additionally, the one check valve 130 can have turbulent float devices 150E-150E' disposed upbore and downbore of the valve 130.

Figure 5F:
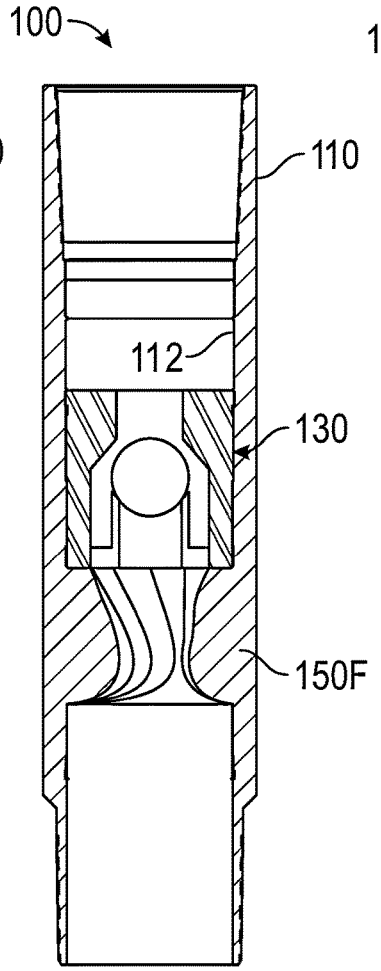
Figure 5G:
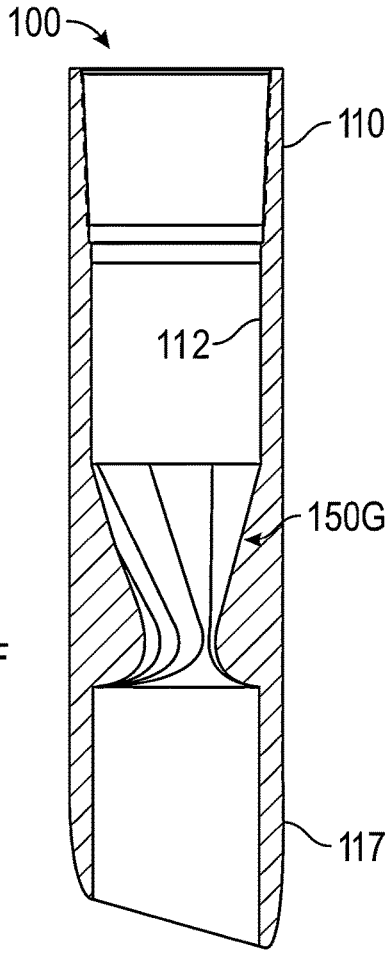

As shown in FIG. 5F, the float tool 100 can include a turbulent float device 150F that is integrated, formed in, or part of the tool's housing 110. As shown in FIG. 5G, the float tool 102 of the present disclosure can include portion of a guide shoe 117 having a turbulent flow device 150G of the present disclosure (any one of which disclosed herein). The float tool 100 can be used with a conventional float collar having one or more valves or can be used with any of the other float tools 100 disclosed herein. This turbulent flow device 150B can be integrated into the housing 110, can be a separate ring, or can be some other configuration disclosed herein.

Figure 5H:
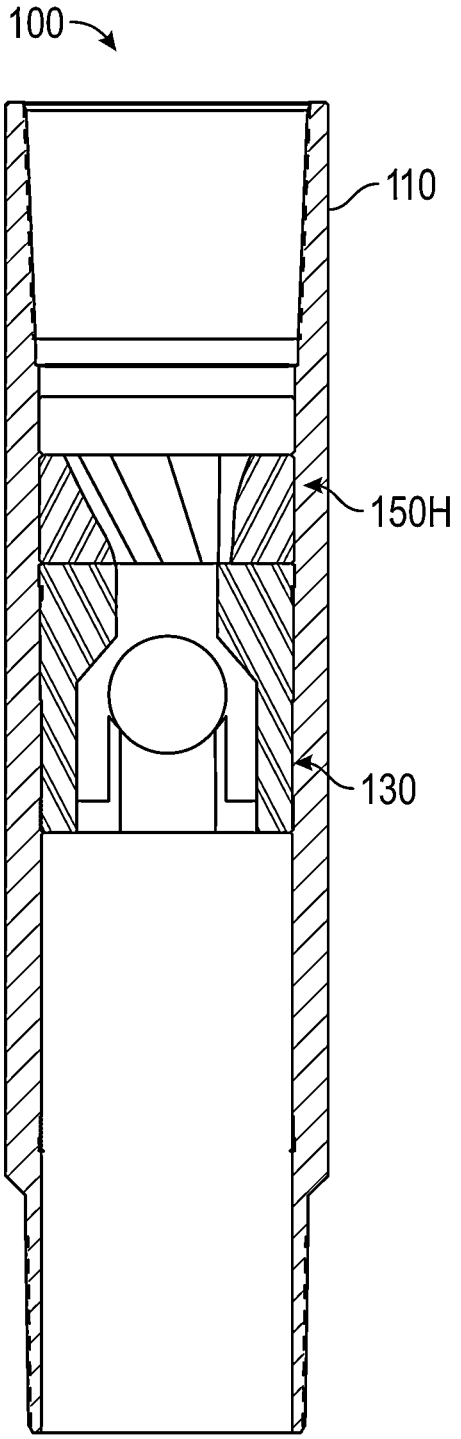
Figure 5I:
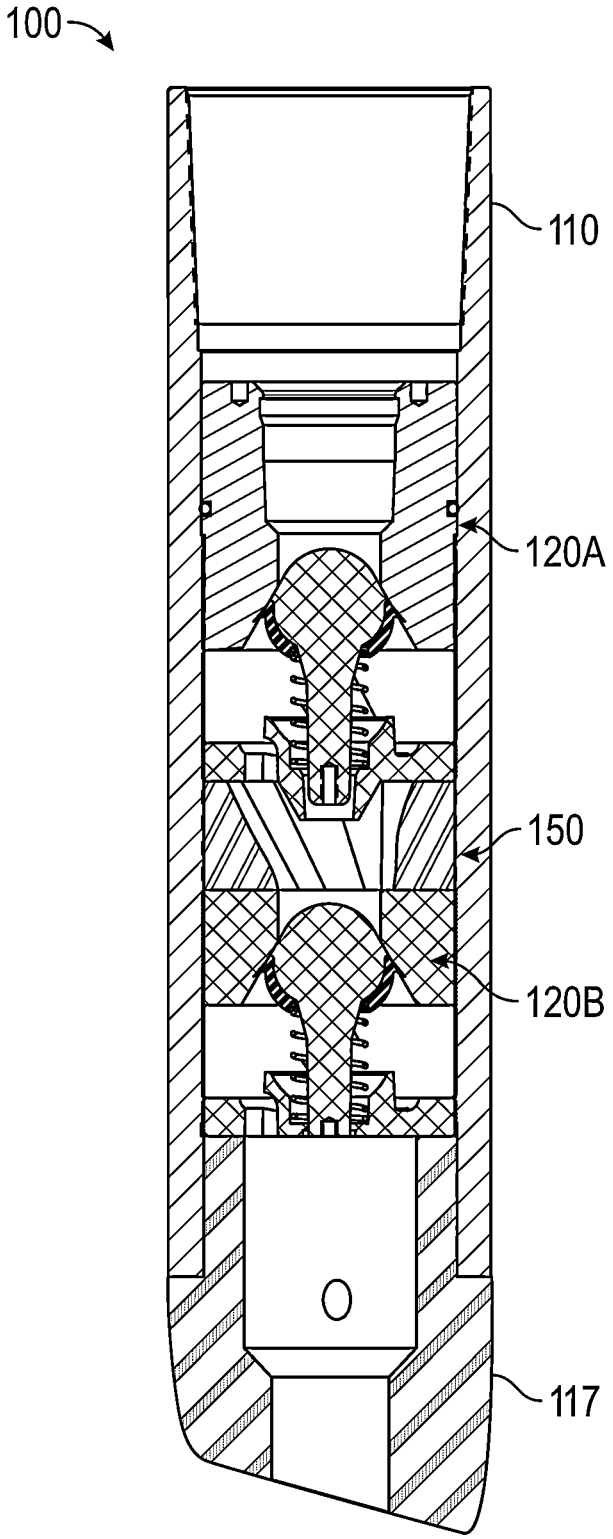

As shown in FIG. 5H, the float tool 100 can include a turbulent float device 150H that is disposed upbore of one or more of the valves (here being one type of valve 130). As shown in FIG. 5I, the float tool 100 of the present disclosure can be a float shoe having a guide shoe 117, one or more valves 120A-B, and a turbulent flow device 150I of the present disclosure (any one of which disclosed herein).

As disclosed herein, the turbulent flow devices 150 can be used upbore of one or more valves, downbore of one or more valves, and/or between valves. Additionally, the turbulent flow devices 150 can be used internally to (or part of) the one or more valves. This has been reflected in each of the previous configurations.

The turbulent flow devices 150 disclosed herein can comprise a suitable material, such as a drillable material of metal, plastic, or the like. One example of a drillable material is a phenolic material. Others can be used. Where the turbulent flow device 150 is part of the housing 110, the turbulent flow device 150 can be composed of the same material as the housing 110.

As will be appreciated, any components of the float tools 100 disclosed herein can combine any of the turbulent flow devices 150 disclosed herein. Accordingly, the foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

The invention claimed is:

1. A float tool for controlling flow in tubing, the float tool comprising:

a housing configured to install on the tubing and defining a longitudinal bore therethrough;

a first valve disposed in the longitudinal bore, the first valve being configured to allow the flow in a downbore direction through the longitudinal bore and being configured to prevent the flow in an upbore direction through the longitudinal bore; and a first inset disposed in the longitudinal bore upbore of the first valve, the first inset having an exterior surface disposed adjacent an interior surface of the longitudinal bore, the first inset having one or more first vanes extending inward to a central portion, the one or more first vanes forming a first orifice at the central portion and being disposed at a first angle relative to the longitudinal bore, the one or more first vanes being configured to produce turbulence in the flow in the downbore direction through the longitudinal bore.

2. The float tool of claim 1, wherein the float tool further comprises a second inset disposed in the longitudinal bore downbore of the first valve.

3. The float tool of claim 1, wherein the first valve is selected from the group consisting of a flapper valve, a poppet valve, and a captured ball valve.

4. The float tool of claim 1, wherein the first valve comprises:

a seat disposed in the longitudinal bore and defining a flow passage therethrough;

a support disposed in the longitudinal bore downbore of the seat; and a ball movably disposed between the seat and the support.

5. The float tool of claim 1, wherein the first valve comprises:

a seat disposed in the longitudinal bore and defining a flow passage therethrough; and a flapper hingedly connected in the longitudinal bore and being movable relative to the seat.

6. The float tool of claim 1, wherein the first orifice has an upbore end and a downbore end, the first orifice defining a first opening at the upbore end and defining a second opening at the downbore end, the first opening having a larger size than the second opening.

7. The float tool of claim 1, wherein the first orifice has an upbore end and a downbore end, the first orifice defining a first opening at the upbore end and defining a second opening at the downbore end, the first opening having a same size as the second opening.

8. The float tool of claim 1, wherein the one or more first vanes spiral uniformly at the first angle about a circumference of the interior surface.

9. The float tool of claim 1, further comprising a second valve disposed in the longitudinal bore upbore or downbore of the first valve, the second valve being configured to allow the flow in the downbore direction through the longitudinal bore and being configured to prevent the flow in the upbore direction through the longitudinal bore.

10. A float tool for controlling flow in tubing, the float tool comprising:

a housing configured to install on the tubing and defining a longitudinal bore therethrough;

a first valve disposed in the longitudinal bore, the first valve being configured to allow the flow in a downbore direction through the longitudinal bore and being configured to prevent the flow in an upbore direction through the longitudinal bore; and an inset disposed in the longitudinal bore downbore of the first valve, the inset having an exterior surface disposed adjacent an interior surface of the longitudinal bore, the inset having one or more vanes extending inward to a central portion in the longitudinal bore, the one or more vanes forming a first orifice at the central portion and being disposed at an angle relative to the longitudinal bore, the one or more vanes being configured to produce turbulence in the flow in the downbore direction through the longitudinal bore; and a second valve disposed in the longitudinal bore downbore of the inset, the second valve being configured to allow the flow in the downbore direction through the longitudinal bore and being configured to prevent flow in the upbore direction through the longitudinal bore.

11. The float tool of claim 10, wherein the first valve comprises:

a first seat disposed in the longitudinal bore and defining a first flow passage therethrough;

a first support disposed in the longitudinal bore downbore of the first seat; and a first poppet movably disposed on the first support and being biased toward the first seat.

12. The float tool of claim 11, wherein the second valve comprises:

a second seat disposed in the longitudinal bore and defining a second flow passage therethrough;

a second support disposed in the longitudinal bore downbore of the second seat; and a second poppet movably disposed on the second support and being biased toward the second seat.

13. The float tool of claim 10, wherein the first valve is selected from the group consisting of a flapper valve, a poppet valve, and a captured ball valve; and wherein the second valve is selected from the group consisting of a flapper valve, a poppet valve, and a captured ball valve.

14. The float tool of claim 10, wherein the first valve is one of:

a poppet valve having a seat, a support, and a poppet, the inset disposed between the support of the poppet valve and the second valve;

a ball valve having a seat, a support, and a ball, the inset disposed between the support of the ball valve and the second valve; and a flapper valve having a flapper and a seat, the inset disposed between the support of the flapper valve and the second valve, the flapper being movable in the central portion of the one or more vanes.

15. A float tool for controlling flow in tubing, the float tool comprising:

a housing configured to install on the tubing and defining a longitudinal bore therethrough;

a first valve disposed in the longitudinal bore, the first valve being configured to allow the flow in a downbore direction through the longitudinal bore and being configured to prevent the flow in an upbore direction through the longitudinal bore, the first valve comprising: a first seat disposed in the longitudinal bore and defining a first flow passage therethrough; a first support disposed in the longitudinal bore downbore of the first seat; and a first poppet movably disposed on the first support and being biased toward the first seat;

a second valve disposed downbore of the first valve, the second valve comprising: a second seat disposed in the longitudinal bore and defining a second flow passage therethrough; a second support disposed in the longitudinal bore downbore of the second seat; and a second poppet movably disposed on the second support and being biased toward the second seat; and one or more vanes extending inward from an interior surface of the longitudinal bore to a central portion in the longitudinal bore and forming an orifice at the central portion, the one or more vanes being disposed between the first support and the second seat and being disposed at an angle relative to the longitudinal bore, the one or more vanes being configured to produce turbulence in the flow in the downbore direction through the longitudinal bore.

16. The float tool of claim 15, wherein the one or more vanes are integrally formed on the interior surface of the longitudinal bore.

17. A float tool for controlling flow in tubing, the float tool comprising:

a housing configured to install on the tubing and defining a longitudinal bore therethrough;

a first valve disposed in the longitudinal bore, the first valve being configured to allow the flow in a downbore direction through the longitudinal bore and being configured to prevent the flow in an upbore direction through the longitudinal bore, the first valve comprising: a seat disposed in the longitudinal bore and defining a flow passage therethrough; a support disposed in the longitudinal bore downbore of the seat; and a ball movably disposed between the seat and the support; and one or more vanes extending inward from an interior surface of the longitudinal bore to a central portion in the longitudinal bore, the one or more vanes forming an orifice at the central portion, wherein the one or more vanes are disposed between the seat and the support and are disposed at an angle relative to the longitudinal bore, the ball being movably disposed in the orifice, the one or more vanes being configured to produce turbulence in the flow in the downbore direction through the longitudinal bore.

18. The float tool of claim 17, wherein the one or more vanes are integrally formed in the flow passage of the first valve.

19. A float tool for controlling flow in tubing, the float tool comprising:

a housing configured to install on the tubing and defining a longitudinal bore therethrough;

a valve disposed in the longitudinal bore, the valve being configured to allow the flow in a downbore direction through the longitudinal bore and being configured to prevent the flow in an upbore direction through the longitudinal bore, the valve comprising: a seat disposed in the longitudinal bore and defining a flow passage therethrough; and a flapper hingedly connected in the longitudinal bore and being movable relative to the seat; and one or more vanes extending inward from an interior surface of the longitudinal bore to a central portion in the longitudinal bore, the one or more vanes forming an orifice at the central portion and being disposed at an angle relative to the longitudinal bore, the one or more vanes being configured to produce turbulence in the flow in the downbore direction through the longitudinal bore, wherein the one or more first vanes are disposed upbore of the seat.

20. The float tool of claim 19, wherein the one or more vanes are integrally formed in the flow passage of the valve.

* * * * *